US012624504B2

(12) United States Patent
Cimpeanu et al.

(10) Patent No.: US 12,624,504 B2
(45) Date of Patent: May 12, 2026

(54) PROCESS FOR PRODUCING AN AQUEOUS POLYMER DISPERSION FROM A VINYL AROMATIC COMPOUND AND A CONJUGATED ALIPHATIC DIENE

(71) Applicant: BASF SE, Ludwigshafen am Rhein (DE)

(72) Inventors: Carmen-Elena Cimpeanu, Ludwigshafen am Rhein (DE); Christian Jehn-Rendu, Ludwigshafen am Rhein (DE); Justin Andrew Bordley, Charlotte, NC (US); Claudia Wood, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 18/838,062

(22) PCT Filed: Feb. 6, 2023

(86) PCT No.: PCT/EP2023/052823

§ 371 (c)(1),
(2) Date: Aug. 13, 2024

(87) PCT Pub. No.: WO2023/152084

PCT Pub. Date: Aug. 17, 2023

(65) Prior Publication Data

US 2025/0146225 A1 May 8, 2025

(30) Foreign Application Priority Data

Feb. 14, 2022 (EP) ..... 22156655

(51) Int. Cl.

| | |
|---|---|
| ***D21H 19/20*** | (2006.01) |
| ***D21H 19/58*** | (2006.01) |
| ***D21H 21/16*** | (2006.01) |
| ***D21H 21/18*** | (2006.01) |

(52) U.S. Cl.
CPC ..... *D21H 19/20* (2013.01); *D21H 19/58* (2013.01); *D21H 21/16* (2013.01); *D21H 21/18* (2013.01)

(58) Field of Classification Search
None
See application file for complete search history.

(56) References Cited

U.S. PATENT DOCUMENTS

| | | | | |
|---|---|---|---|---|
| 4,474,860 | A | 10/1984 | Van Gilder et al. | |
| 4,567,099 | A | 1/1986 | Van Gilder et al. | |
| 4,780,503 | A * | 10/1988 | Mallya | C08F 36/04 526/201 |
| 5,726,259 | A | 3/1998 | Hayes et al. | |
| 2006/0148981 | A1 * | 7/2006 | Schmidt-Thummes | C08F 236/04 524/745 |
| 2010/0204382 | A1 | 8/2010 | Evstatieva et al. | |
| 2022/0251248 | A1 * | 8/2022 | Cimpeanu | C09D 125/10 |

FOREIGN PATENT DOCUMENTS

| | | | |
|---|---|---|---|
| CN | 109180847 | A | 1/2019 |
| DE | 4419518 | A1 | 12/1995 |

(Continued)

OTHER PUBLICATIONS

European Search Report for EP Patent Application No. 22156655.7, Issued on Jul. 14, 2022, 3 pages.

(Continued)

*Primary Examiner* — Alexander M Weddle
(74) *Attorney, Agent, or Firm* — Faegre Drinker Biddle & Reath LLP

(57) ABSTRACT

The invention relates to a process for producing an aqueous polymer dispersion by means of radically initiated aqueous emulsion polymerisation by polymerising, in an aqueous medium, in accordance with a monomer feed process: (a) 40 to 75 parts by weight styrene; (b) 24.9 to 59.9 parts by weight butadiene; (c) 0.1 to 10 parts by weight of at least one ethylenically unsaturated carboxylic acid; and (d) 0 to 15 parts by weight other monomers, wherein the parts by weight of monomers (a) to (d) add up to 100 parts by weight, which process comprises the following steps: a) creating a template of a seed latex and 1 to 10 parts by weight monomers, based on the total monomer amount; b) starting the polymerisation at a temperature ≥80° C. in this template; and c) subsequently steadily metering monomers and emulsifier into this reaction mixture; c1) wherein at a time when 40 to 55% of the total metering time of the monomers has elapsed and 40 to 55 parts by weight of the monomer amounts to be metered in are metered in, the metering rate of the emulsifier for a period P2 that lasts at most for 30 minutes is increased to 10 to 100 times the average metering rate of the emulsifier during the period P1, wherein the period P1 is the preceding length of time beginning with the start of the emulsifier metering; c2) and at a time when 60 to 85% of the total metering time of the monomers has elapsed and 60 to 85 parts by weight of the monomer amount to be metered in are metered in, the metering rate of the emulsifier for a period P4 that lasts at most 30 minutes is increased to 10 to 120 times the average metering rate of the emulsifier of the period P1 and with the proviso that the aqueous polymer dispersion has a solids content of ≥58 wt. %. The invention also relates to the dispersion obtained according to the process, and to the use thereof as a binder, adhesive, sizing agent for fibres, for producing coatings or for producing a paper coating slip.

13 Claims, No Drawings

(56) References Cited

FOREIGN PATENT DOCUMENTS

| | | | | |
|---|---|---|---|---|
| DE | 4435422 | A1 | 4/1996 | |
| DE | 4435423 | A1 | 4/1996 | |
| EP | 1354009 | A1 | 10/2003 | |
| WO | 02/70615 | A1 | 9/2002 | |
| WO | WO-2020249406 | A1 * | 12/2020 | ..... C08F 2/38 |

OTHER PUBLICATIONS

Hayes, et al., "Styrene-Butadiene and Styrene-Acrylic Latices in Paper Coating Applications", Coating Materials: Pigments, Binders and Additives short course, Mar. 11-13, 2002, pp. 115-123.

International Preliminary Report on Patentability received for PCT Patent Application No. PCT/EP2023/052823, mailed on Aug. 29, 2024, 7 pages.

International Search Report and Written Opinion received for PCT Patent Application No. PCT/EP2023/052823, mailed on Apr. 11, 2023, 17 pages (7 pages of English Translation and 10 pages of Original Document).

* cited by examiner

PROCESS FOR PRODUCING AN AQUEOUS POLYMER DISPERSION FROM A VINYL AROMATIC COMPOUND AND A CONJUGATED ALIPHATIC DIENE

CROSS-REFERENCE TO RELATED APPLICATIONS

This application is a National stage application (under 35 U.S.C. § 371) of PCT/EP2023/052823, filed Feb. 6, 2023, which claims benefit of European Application No. 22156655.7, filed Feb. 14, 2022, both of which are incorporated herein by reference in their entirety.

The invention relates to a process for producing an aqueous polymer dispersion having a polymodal particle distribution of the polymer particles by copolymerizing a vinylaromatic compound and a conjugated aliphatic diene. The invention also relates to the aqueous polymer dispersions produced by the process and to the use of these as binder for adhesives, sizing agents, fibers, coating compositions and paper coating slips.

Binders for paper coating slips that are based on copolymers of vinylaromatic compounds and aliphatic dienes are often chosen for applications such as packaging board. Because of ever-increasing production speeds of the paper machines, there are rising demands on the rheology of the coating slip. In spite of the high pigment content, which is of course coarser than the binder polymer, the latter has a strong influence on the rheology of a coating slip. It would be possible to lower the viscosity of the coating slip by greater dilution, but what is desired is the exact opposite. Thus, modern dispersions are supposed to have a high solids content and nevertheless to have low viscosity at high speeds. Conventional polymer emulsions having a monomodal particle size distribution generally have a solids content of ≤50% by weight. Above a solids content of 50%, the dispersions generally have an unacceptable viscosity.

Peter C. Hayes states that, in the case of high solids contents of coating slips with styrene-butadiene binders, running characteristics are improved by relatively small particles of the binder ("*Styrene-butadiene and styrene-acrylic latexes in paper coating applications*", Coating Material: Pigment Binders & Additives Short Course, Orange Beach, AL, United States, Mar. 11-13, 2002, pages 115-123, TAPPI PRESS, Atlanta, 2002).

U.S. Pat. Nos. 4,567,099 and 4,474,860 teach the use of a blend of two styrene/butadiene dispersions of different particle size for paper coating applications. However, the mixing of two dispersions typically leads to dilution of the overall dispersion since dispersions with small particle size can be produced only with a relatively low solids content. It is only by subsequent concentration of the blend that higher solids contents are achieved. Such concentration, i.e. subsequent removal of water, is energy-intensive and takes a long time. Moreover, two dispersions have to be produced beforehand, which means a poor space-time yield for the overall product.

U.S. Pat. No. 5,726,259 teaches the production of a bimodal styrene/butadiene latex binder for paper coating slips. The latex binder is produced by initiating the polymerization with an in situ seed, adding the monomers in portions by 10 monomer additions and, after 43% of the total amount of monomers has been metered in and 44% of the total metering time has elapsed, a further in situ seed is produced and hence the growth of a second particle population is initiated. This affords polymer dispersions having a solids content of 50% by weight.

U.S. Pat. No. 4,780,503 describes a process for producing a bimodal polymer dispersion, wherein further lauryl ether sulfate is metered in at a juncture of 43-53% monomer conversion. According to this teaching, dispersions having a relatively high solids content are obtained. However, a reaction time of 10 hours is specified, which suggests a reaction temperature <80° C. Such long reaction times are uneconomic.

WO2020/249406 teaches the production of a bimodal styrene/butadiene/acrylic acid dispersion by, after metering in 17% to 25% of the total amount of monomers, adding a large amount of emulsifier all at once, hence initiating the growth of a second particle population. The dispersions thus obtained have low odor, but only a solids content of 53% by weight.

It was therefore an object of the present invention to find a process for producing styrene/butadiene polymer dispersions having a solids content of at least 58% that has an improved space-time yield. The polymer dispersion obtained thereby is to have a viscosity <1000 mPas, Brookfield, 100 rpm, spindle 3 at 23° C., such that, incorporated into paper coating slips, it has good rheological characteristics even at high shear forces. It is preferably to be polymodal.

The object is achieved in accordance with the invention by a process for producing an aqueous polymer dispersion by free-radically initiated aqueous emulsion polymerization, which comprises polymerizing, in an aqueous medium, (a) 40 to 75 parts by weight of styrene,
(b) 24.9 to 59.9 parts by weight of butadiene,
(c) 0.1 to 10 parts by weight of at least one ethylenically unsaturated carboxylic acid and
(d) 0 to 15 parts by weight of other monomers, where the parts by weight of monomers (a) to (d) add up to 100 parts by weight, by a monomer feed process comprising the following steps:

a) initially charging a seed latex and 1 to 10 parts by weight of monomers based on the total amount of monomers,
b) initiating the polymerization at a temperature ≥80° C. in this initial charge;
c) and then constantly metering monomers and emulsifier into this reaction mixture,
c1) wherein, at a time when 40% to 55% of the total monomer metering time has elapsed and 40 to 55 parts by weight of the amount of monomers to be metered in have been metered in, the metering rate of the emulsifier is increased for a period P2 of not longer than 30 minutes to 10 to 150 times the average metering rate of the emulsifier during the period P1, where the period P1 is the preceding period of time commencing with the start of emulsifier metering,
c2) and, at a time when 60% to 85% of the total monomer metering time has elapsed and 60 to 85 parts by weight of the amount of monomers to be metered in have been metered in, the metering rate of the emulsifier is increased for a period P4 of not longer than 30 minutes to 10 to 150 times the average metering rate of the emulsifier in period P1, and with the proviso that the aqueous polymer dispersion has a solids content of ≥58% by weight.

The invention further relates to the dispersion obtained by the process of the invention, and to the use thereof as binder, adhesive, sizing agent for fibers, for production of coatings or for production of a paper coating slip.

Some compounds which derive from acrylic acid and methacrylic acid are abbreviated hereinafter by insertion of the syllable "(meth)" into the compound derived from acrylic acid.

What is meant by "total amount of monomers" is the total amount of all monomers used in the polymerization that add up to 100 parts by weight.

With regard to the total amount of monomers to be metered in, what this means is the total amount of monomers minus the monomers in the initial charge. If it says that 40 parts by weight of the amount of monomers to be metered in have been metered in, this relates to the proportion metered in.

Total monomer metering time means the period of time taken for the constant metered addition of monomers. The metered addition can be effected in the form of addition of a mixture and in the form of separate monomers, the addition of which may also commence with a time delay. What is crucial is that monomer is being metered in at every juncture, i.e. the addition is constant. Accordingly, the total metering time commences with the commencement of metered addition of the first monomer (mixture) and ends with the end of the last monomer (mixture).

Metering rate is understood to mean an amount which is added in a unit of time, i.e. "amount per unit time", typically in "g/min". For example, the average metering rate in period P1 of the emulsifier is the amount of all emulsifiers which is metered in during period P1, based on the duration of the period.

With regard to the solids content of the aqueous dispersion in % by weight, this is based on the weight of the aqueous dispersion.

According to the invention, a monomer composition comprising styrene, butadiene and at least one ethylenically unsaturated carboxylic acid is free-radically polymerized. In addition, other monomers may be present.

Examples of ethylenically unsaturated carboxylic acids (monomers (c)) include α,β-monoethylenically unsaturated mono- and dicarboxylic acids having 3 to 6 carbon atoms in the molecule. Examples of these are acrylic acid, methacrylic acid, itaconic acid, maleic acid, fumaric acid, crotonic acid, vinylacetic acid and vinyllactic acid. The at least one ethylenically unsaturated carboxylic acid is preferably selected from acrylic acid, methacrylic acid and itaconic acid.

The ethylenically unsaturated carboxylic acids may be used in the polymerization in the form of the free acids or else in a form partially or completely neutralized by suitable bases. Preference is given to using sodium hydroxide solution, potassium hydroxide solution and/or ammonia as neutralizing agent.

Other monoethylenically unsaturated monomers (d) are optionally added for modification of the polymers. These are monomers other than the monomers of groups (a), (b), and (c), i.e. not styrene, butadiene or ethylenically unsaturated carboxylic acids.

In a preferred embodiment, the monomer composition comprises one or more other monoethylenically unsaturated monomers (d) in an amount of 0.1 to 15 parts by weight, based on total monomers.

Preferred monomers (d) are acrylamide and/or methacrylamide (monomers (d1)).

In addition, it is possible to use other monoethylenically unsaturated monomers (d2) that are different than the monomers of groups (a), (b), (c) and (d1), i.e. not styrene, butadiene, acrylamide, methacrylamide or ethylenically unsaturated carboxylic acids.

Other monoethylenically unsaturated monomers (d2) are preferably selected from acrylonitrile, methacrylonitrile, N-methylolacrylamide, N-methylol(meth)acrylamide, vinyl esters of saturated $C_1$ to $C_{18}$ carboxylic acids, preferably vinyl acetate, and esters of acrylic acid and methacrylic acid with monohydric $C_1$ to $C_{18}$ alcohols such as methyl acrylate, methyl methacrylate, ethyl acrylate, ethyl methacrylate, n-propyl acrylate, n-propyl methacrylate, isopropyl acrylate, isopropyl methacrylate, n-butyl acrylate, n-butyl methacrylate, isobutyl acrylate, isobutyl methacrylate, sec-butyl acrylate, sec-butyl methacrylate, tert-butyl acrylate, tert-butyl methacrylate, pentyl acrylates, pentyl methacrylates, 2-ethylhexyl acrylate, 2-ethylhexyl methacrylate, allyl esters of saturated carboxylic acids, vinyl ethers, vinyl ketones, dialkyl esters of ethylenically unsaturated carboxylic acids, N-vinylpyrrolidone, N-vinylpyrrolidine, N-vinylformamide, N,N-dialkylaminoalkylacrylamides, N,N-dialkylaminoalkylmethacrylamides, N,N-dialkylaminoalkyl acrylates, N,N-dialkylaminoalkyl methacrylates, vinyl chloride and vinylidene chloride, and mixtures thereof.

Monomers (d2) used are more preferably acrylonitrile and methacrylonitrile.

The styrene content is 40 to 75 parts by weight and preferably 45 to 70 parts by weight, especially 50 to 65 parts by weight, based on 100 parts by weight of total monomers per se.

The amount of butadiene is 24.9 to 59.9 parts by weight, preferably 29.9 to 54.9 parts by weight, based on 100 parts by weight of total monomers.

The total amount of monomers (c) is 0.1 to 10 parts by weight, preferably 0.1 to 8 parts by weight or 1 to 6 parts by weight, based on 100 parts by weight of total monomers.

If monomers (d) are present, the total amount thereof (d1+d2) is up to 15 parts by weight, preferably 0.1 to 10 parts by weight, especially 0.5 to 6 parts by weight, based on 100 parts by weight of total monomers.

Preference is given to polymerizing, in an aqueous medium, (a) 40 to 75 parts by weight of styrene,
(b) 24.8 to 59.8 parts by weight of butadiene,
(c) 0.1 to 10 parts by weight of at least one ethylenically unsaturated carboxylic acid and
(d1) 0.1 to 5 parts by weight of acrylamide and/or methacrylamide,
(d2) 0 to 10 parts by weight of one or more other monoethylenically unsaturated monomers, where the parts by weight of monomers (a) to (d), i.e. (d1) and if present (d2), add up to 100 parts by weight.

In the case of a preferred monomer (d1), it is preferably used in an amount of 0.3 to 5 parts by weight and in particular 0.4 to 3 parts by weight, based on 100 parts by weight of total monomer.

If monomers (d2) are present, preferably acrylonitrile and/or methacrylonitrile, they are preferably used in an amount up to at most 10 parts by weight, especially up to at most 7 parts by weight, and preferably at least 1 part by weight, especially at least 3 parts by weight, based on 100 parts by weight of total monomer.

It is advantageous to polymerize (a) 45 to 70 parts by weight of styrene,
(b) 25 to 50 parts by weight of butadiene,
(c) 1 to 8 parts by weight of at least one ethylenically unsaturated carboxylic acid,
(d1) 0.3 to 5 parts by weight of acrylamide and/or methacrylamide,
(d2) 0 to 10 parts by weight of other monoethylenically unsaturated monomers, where the parts by weight of monomers (a) to (d), i.e. (d1) and if present (d2), add up to 100 parts by weight (total amount of monomers).

Particular preference is given to polymerizing (a) 50 to 65 parts by weight of styrene, (b) 30 to 45 parts by weight of butadiene, (c) 1 to 6 parts by weight of at least one ethylenically unsaturated carboxylic acid, (d1) 0.4 to 3 parts by weight of acrylamide and/or methacrylamide, (d2) 0 to 10 parts by weight of other monoethylenically unsaturated monomers, where the parts by weight of monomers (a) to (d) add up to 100 parts by weight (total amount of monomers).

The emulsion polymerization is effected in an aqueous medium. This may be, for example, fully demineralized water or else mixtures of water and a solvent miscible therewith, such as methanol, ethanol, ethylene glycol, glycerol, sugar alcohols such as sorbitol, or tetrahydrofuran. Preference is given to water.

The total amount of the aqueous medium is proportioned here such that the aqueous polymer dispersion obtained has a solids content of preferably 59% by weight, more preferably 59% to 65% by weight, especially 60% by weight, based on the weight of the aqueous dispersion.

The process of the invention is a monomer feed process. What is meant by monomer feed processes is that the majority, typically at least 90 parts by weight, preferably at least 93 parts by weight, of the monomers to be polymerized is supplied to the polymerization reaction under polymerization conditions.

According to the invention, a portion of the monomers forms an initial charge in the polymerization reactor before commencement of the polymerization. This may comprise one or more monomers of the monomer composition. It is thus possible to initiate the polymerization in this initial charge comprising 1 to 10 parts by weight, preferably 1 to 7 parts by weight, of the total amount of monomers, and then to constantly meter in monomers and emulsifier. In particular, up to 5 parts by weight of the overall monomer composition is initially charged and then the polymerization is initiated.

Polymerization conditions are generally understood to mean those amounts of free-radical initiator, temperatures and pressures under which the free-radically initiated aqueous emulsion polymerization does not come to a halt. The polymerization depends in principle on the nature and amount of the free-radical initiator used. The relationships between temperature and decomposition rate are sufficiently well known to those skilled in the art for the standard polymerization initiators or can be determined in routine experiments.

According to the invention, the monomers and the emulsifier are metered in constantly. In other words, monomer and emulsifier are metered in in a continuous stream of matter, i.e. without interruption.

The respective monomer is preferably metered in at a metering rate that varies from the average value of the respective overall feed of that monomer by not more than 30%, preferably by not more than 20%.

According to a preferred embodiment, the metering rate of the monomers (increase in the monomers) corresponds approximately to the polymerization rate of the monomers (decrease in the monomers).

According to one embodiment, the constant metered addition of the monomers of groups (a), (b), (c) and, if present, (d) commences simultaneously.

The monomers are preferably metered in in a constant mass flow, preferably over a period of at least 100 minutes, more preferably over a period of 100 to 300 minutes, especially over a period of 150 to 270 minutes (total monomer metering time).

Emulsifier in the context of the process of the invention means emulsifying aids. The person skilled in the art will typically consider this to mean emulsifying aids that keep both the monomer droplets and polymer particles dispersed in the aqueous phase and hence ensure the stability of the aqueous polymer dispersion produced. Useful emulsifiers are those that are typically used for performance of free-radical aqueous emulsion polymerizations.

Useful emulsifiers include interface-active substances having a number-average molecular weight of typically below 2000 g/mol or preferably below 1500 g/mol.

Suitable emulsifiers are not only anionic and cationic emulsifiers but also nonionic emulsifiers. Interface-active substances used are preferably emulsifiers that typically have relative molecular weights below those of protective colloids.

Suitable anionic emulsifiers are, for example, alkali metal and ammonium salts of alkyl sulfates (alkyl radical: $C_8$-$C_{22}$), of sulfuric monoesters of ethoxylated alkanols (EO level: 2 to 50, alkyl radical: $C_{12}$-$C_{18}$) and ethoxylated alkylphenols (EO level: 3 to 50, alkyl radical: $C_4$-$C_9$), of alkylsulfonic acids (alkyl radical: $C_{12}$-$C_{18}$) of alkylarylsulfonic acids (alkyl radical: $C_9$-$C_{18}$) and of diesters of sulfosuccinic acid with $C_4$-$C_{13}$-alkanols. Further suitable emulsifiers can be found in Houben-Weyl, Methoden der organischen Chemie [Methods of Organic Chemistry], volume XIV/1, Makromolekulare Stoffe [Macromolecules], Georg-Thieme-Verlag, Stuttgart, 1961, p. 192-208. Likewise suitable as anionic emulsifiers are bis(phenylsulfonic acid) ethers and the alkali metal or ammonium salts thereof which bear a $C_4$-$C_{24}$ alkyl group on one or both aromatic rings. These compounds are generally known, for example from U.S. Pat. No. 4,269,749, and commercially available, for example as Dowfax® 2A1 (Dow Chemical Company).

Suitable nonionic emulsifiers are araliphatic or aliphatic nonionic emulsifiers, for example ethoxylated mono-, di- and trialkylphenols (EO level: 3 to 50, alkyl radical: $C_4$-$C_{10}$), ethoxylates of long-chain alcohols (EO level: 3 to 100, alkyl radical: $C_8$-$C_{36}$), and polyethylene oxide/polypropylene oxide homo- and copolymers. These may comprise the alkylene oxide units copolymerized in random distribution or in the form of blocks. Very suitable examples are EO/PO block copolymers. Preference is given to ethoxylates of long-chain alkanols (alkyl radical: $C_1$-$C_{30}$, average ethoxylation level 5 to 100) and, among these, particular preference is given to those having a linear $C_{12}$-$C_{20}$ alkyl radical and an average ethoxylation level of 10 to 50, and also to ethoxylated monoalkylphenols.

Preference is given to using at least one anionic and/or at least one nonionic emulsifier.

The emulsifier is preferably selected from alkali metal and ammonium salts of $C_8$-$C_{22}$-alkyl sulfates and of sulfuric monoesters of ethoxylated alkanols (EO level: 2 to 40, alkyl radical: $C_{12}$-$C_{18}$) and of sulfuric monoesters of ethoxylated alkylphenols (EO level: 10 to 40, alkyl radical: $C_4$-$C_9$), and bis(phenylsulfonic acid) ethers or the alkali metal or ammonium salts thereof that bear a $C_4$-$C_{24}$-alkyl group on one or both aromatic rings.

Particular preference is given to using a mixture of emulsifiers, each in the form of their alkali metal and ammonium salts, especially a mixture of alkyl sulfates (alkyl radical: $C_8$-$C_{22}$) with sulfuric monoesters of ethoxylated alkanols (EO level: 2 to 40, alkyl radical: $C_{12}$-$C_{18}$) or with sulfuric monoesters of ethoxylated alkylphenols (EO level: 10 to 40, alkyl radical: $C_4$-$C_9$) or with 2-ethylhexyl sulfosuccinate, or a mixture of alkali metal and ammonium salts of alkyl sulfates with bis(phenylsulfonic acid) ethers or the alkali metal or ammonium salts thereof that bear a $C_4$-$C_{24}$-alkyl group on one or both aromatic rings (e.g. Dowfax 2A1 from Dow Chemical Company).

Particular preference is given to choosing an emulsifier mixture of sodium lauryl sulfate and ethoxylated sodium lauryl ether sulfate, and a mixture of sodium lauryl sulfate and Dowfax® 2A1.

The constant metered addition of an emulsifier and monomer can be effected in separate mass flows. However, it is advantageous to meter in at least one emulsifier and at least one monomer together as a mixture. It is preferable to constantly meter in, in a mixture with at least one monomer, 0.1 to 5 parts by weight, preferably 0.2 to 2.0 parts by weight, of emulsifier based on 100 parts by weight of monomers.

In this case, emulsifiers are preferably metered in with a metering rate that varies from the average value of the respective overall feed by not more than 30%, preferably by not more than 20%.

According to the invention, after a period P1 when 40% to 55% of the total monomer metering time has elapsed and 40% to 55% of the amount of monomers to be metered in has been metered in, the metering rate of the emulsifier is increased for a period of not longer than 30 minutes to 10 to 150 times the average metering rate of the emulsifier in period P1. The period P1 commences with commencement of the constant metered addition of the monomers, i.e. after the initiation of the polymerization in the initial charge, and ends when 40% to 55%, preferably 45% to 50%, of the total monomer metering time has elapsed and 40 to 55 parts by weight of the amount of monomers to be metered in have been metered in, with choice of mode of metered addition such that both conditions are fulfilled.

The "period of elevated metered addition" that follows period P1 is also referred to hereinafter as "P2". The duration of period P2 is preferably up to 25 minutes, especially 5 to 20 minutes. Because of the elevated rate of metered addition during period P2, this additional metered addition of an emulsifier is also referred to as "emulsifier shot".

Period P2 is followed by a period P3 in which the rate of metered addition of the emulsifier may vary by up to 20% in the upward or downward direction from the metering rate of the emulsifier in period P1.

According to the invention, after this period P3 when 60% to 85% of the total monomer metering time has elapsed and 60 to 85 parts by weight of the amount of monomers to be metered in have been metered in, the metering rate of the emulsifier is increased for a period of not longer than 30 minutes to 10 to 150 times the average metering rate of the emulsifier in period P1. The "period of elevated metered addition" that follows period P3 is also referred to hereinafter as "P4".

Period P4 is followed by a period P5 in which the rate of metered addition of the emulsifier may vary by up to 20% in the upward or downward direction from the metering rate of the emulsifier in period P1.

Preferably, during period P2 and period P4, the rate of metered addition of the emulsifier is 20 to 90 times the average metering rate of the emulsifier in period P1.

The emulsifier used during period P1, P3 and P5, or the emulsifier mixture used, is generally the same. The emulsifier in period P2 and in period P4 may be the same emulsifier as in period P1. If a mixture is used in period P1, it is also possible to use only the amount of one of the emulsifiers in each of periods P2 and P4. Preferably, in period P2 and in period P4, a mixture of the emulsifiers from period P1 is used, but with an altered ratio, for example in that only one of two emulsifiers is additionally metered in as "emulsifier shot".

In a preferred embodiment, a monomer/emulsifier mixture is metered in constantly over the course of the entire feed, i.e. periods P1 to P5, and the rate of metered addition of one of the emulsifiers in the mixture is increased in periods P2 and P4.

The emulsifier preferably chosen in periods P2 and P4 is independently an anionic emulsifier, especially selected from lauryl sulfate, sulfuric monoesters of ethoxylated alkanols and arylsulfonate.

The metered addition is elucidated hereinafter by way of example for a polymerization with initiation in an initial charge and subsequent metered addition of monomers with constant mass flow rate. In example 1, in the initial charge, the polymerization is initiated with 3 parts by weight of the total amount of monomers and then the constant metered addition of a mixture of monomer and emulsifier is commenced. The total amount of all monomers including the monomers in the initial charge is 100 parts by weight (also referred to in the context of this application as total amount of monomers). Thus, 97 parts by weight are being metered in constantly (amount of monomers to be metered in). The total duration of metered addition of monomer is 240 minutes. After 129 minutes counted from commencement of constant metered addition, additional metered addition of the emulsifier is commenced, which lasts for 12 minutes. The increase in the amount of emulsifier, called the emulsifier shot, is thus effected after 52% of the total monomer metering time. After the 129 minutes, 54 parts by weight of monomers have been metered in on account of the constant metered addition of monomer. Over the total metering time of 240 minutes, 1.05 parts by weight of emulsifier based on 100 parts by weight of total monomer are metered in constantly in a mixture with the monomers. Accordingly, after 129 minutes, 0.564 (pphm) part by weight of emulsifier has been metered in. This corresponds to an average metering rate in period P1 of 0.004372 part by weight/min. The metered addition of the emulsifier during the first "emulsifier shot" is 0.68 part by weight over a period of 12 minutes, i.e. a metering rate of 0.056 part by weight/min. This means that, during the emulsifier shot, 0.0603 part by weight per minute is metered in, and the rate of metered addition is hence 13 times (rounded, exactly 13.8 times) the average metering rate of the emulsifier. Analogously, the commencement of the second "emulsifier shot" is after 200 minutes and hence after 83% of the total monomer metering time and after 86% of the amount of monomers to be metered in has been metered in. The metered addition of the emulsifier during the second "emulsifier shot" is 0.5 part by weight over a period of 1 minute, i.e. a metering rate of 0.5 part by weight/min. This means that, during the emulsifier shot, 0.556 part by weight per minute is metered in, and the rate of metered addition is hence 127 times the average metering rate of the emulsifier.

It is assumed that the emulsifier concentration present in the polymerization mixture is below the critical micelle concentration during period P1, and above the critical micelle concentration during periods P2 and P4. According to this theory, new micelles would form in periods P2 and P4, and further particle growth would be commenced in each case. In this respect, because of the two instances of elevated emulsifier addition, a particle size distribution with three maxima would be expected. Since, however, the second addition takes place at a relatively late juncture based on the amount of monomers to be metered in, the third population is likely to be not very pronounced, such that, in some cases, only two maxima are observed in a determination by analytical ultracentrifuge (AUC).

In the process of the invention, free-radical initiators (also referred to as free-radical polymerization initiators) are used, i.e. initiators that form free radicals under the reaction conditions. These may be five peroxides or azo compounds. Redox initiator systems are of course also suitable.

Peroxides used may in principle be inorganic peroxides and/or organic peroxides. Examples of suitable inorganic peroxides include hydrogen peroxide and peroxodisulfates, such as the mono- or dialkali metal or ammonium salts of peroxodisulfuric acid, for example the mono- and disodium, mono- and dipotassium, or ammonium salts thereof. Examples of suitable organic peroxides are alkyl hydroperoxides such as tert-butyl hydroperoxide, aryl hydroperoxides such as p-menthyl or cumene hydroperoxide, and dialkyl or diaryl peroxides such as di-tert-butyl, dibenzoyl or dicumene peroxide.

Redox initiator systems are combined systems made up of at least one organic or inorganic reducing agent and at least one peroxide. Suitable oxidants for redox initiator systems are essentially the peroxides mentioned above. Corresponding reducing agents that may be used are sulfur compounds in a low oxidation state such as alkali metal sulfites, for example potassium and/or sodium sulfite, alkali metal hydrogen sulfites, for example potassium and/or sodium hydrogen sulfite, alkali metal metabisulfites, for example potassium and/or sodium metabisulfite, acetone bisulfite, formaldehydesulfoxylates, for example potassium and/or sodium formaldehydesulfoxylate, alkali metal salts, specifically potassium and/or sodium salts of aliphatic sulfinic acids and alkali metal hydrogensulfides, for example potassium and/or sodium hydrogensulfide, salts of polyvalent metals, such as iron(II) sulfate, iron(II) ammonium sulfate, iron(II) phosphate, enediols, such as dihydroxymaleic acid, benzoin and/or ascorbic acid, and reducing saccharides, such as sorbose, glucose, fructose and/or dihydroxyacetone.

Preferred free-radical initiators are inorganic and organic peroxides, preferably ammonium or alkali metal salts of peroxosulfates or peroxodisulfates, and tert-butyl hydroperoxide, p-menthyl hydroperoxide and cumyl hydroperoxide, in particular selected from sodium and potassium peroxodisulfate, tert-butyl hydroperoxide and cumyl hydroperoxide. Particular preference is given here to using both at least one inorganic peroxide, preferably peroxodisulfate, in particular sodium peroxodisulfate, and one organic peroxide, preferably alkyl hydroperoxide, in particular t-butyl hydroperoxide.

The polymerization is generally effected using 0.1 to 5 parts by weight of the free-radical initiator, preferably 0.5 to 4 parts by weight of the free-radical initiator, preferably at least one inorganic and/or organic peroxide, based on 100 parts by weight of total monomers.

Initiation of the polymerization reaction is understood to mean the start of the polymerization reaction of the monomers present in the polymerization vessel as a result of decomposition of the free-radical initiator. The polymerization is initiated, for example, when the polymerization mixture comprises monomers and inorganic peroxide and reaches a temperature in the range from ≥80° C. to ≤95° C.

For example, in order to initiate the polymerization, an aqueous mixture comprising a portion of protective colloid and/or an emulsifier in dissolved form, a portion of monomer and the seed latex is first prepared. This mixture is heated to a temperature above the breakdown temperature of the free-radical initiator, and a portion of the free-radical initiator is metered in. After a period of 1 to 15 minutes, preferably 1 to 10 minutes, after addition of the free-radical initiator, the metered addition of the monomers is commenced. Advantageously, a further amount of free radical initiator, preferably inorganic peroxide, is metered in simultaneously with the monomers.

As in all free-radical polymerization reactions, it is advantageous when the initial charging of the reaction components, the metering/polymerization and the post-reaction are effected in the reaction vessel under an inert gas atmosphere, for example under nitrogen or argon atmosphere.

Preferred polymerization conditions are a temperature in the range from ≥80° C. to ≤115° C., preferably ≥85° C. to ≤110° C., especially ≥90° C. to ≤105° C.

The conjugated aliphatic diene is generally metered in at elevated pressure. The metered addition of the conjugated aliphatic diene preferably takes place at a pressure in the range from 5 to 15 bar. The effect of the elevated pressure is that, for example, the 1,3-butadiene which is gaseous at standard pressure and room temperature is present largely in the polymerization mixture.

The polymerization can be conducted in the presence of a degraded starch.

In a preferred embodiment, the polymerization takes place in the presence of a degraded starch, preferably in the presence of 15 to 100 parts by weight of a degraded starch based on 100 parts by weight of total monomers. Degraded starches are common knowledge and are described, for example, in WO2020/249406 on page 15 to page 16 line 2.

Preference is given to degraded native starches, in particular native starches degraded to maltodextrin.

Preference is given to degraded starches having an intrinsic viscosity ηi of ≤0.07 dl/g or ≤0.05 dl/g. The intrinsic viscosity ηi of the degraded starches is preferably in the range from 0.02 to 0.06 dl/g. The intrinsic viscosity ηi is determined in accordance with DIN EN 1628 at a temperature of 23° C.

In a further preferred embodiment, no degraded starch is present during the polymerization.

According to the invention, the polymerization is conducted in the presence of a seed latex—also referred to as seed polymer.

A seed latex is typically understood by the person skilled in the art to mean a polymer dispersion wherein the seed particles function as centers of particle formation in the polymerization process.

In a preferred process variant, the seed latex used is an aqueous polymer dispersion having a weight-average particle size $D_w50$ in the range from 20 to 60 nm and a $D_w50/D_n50$ ratio ≤2.

In this specification, weight-average particle diameter is understood as meaning the weight-average $D_w50$ value determined by the method of analytical ultracentrifuge and number-average particle diameter is understood as meaning the number-average $D_N50$ value determined by the same method (cf. S. E. Harding et al., Analytical Ultracentrifugation in Biochemistry and Polymer Science, Royal Society of Chemistry, Cambridge, Great Britain 1992, Chapter 10, Analysis of Polymer Dispersions with an Eight-Cell-AUC-Multiplexer: High Resolution Particle Size Distribution and Density Gradient Techniques, W. Machtle, pages 147 to 175). In the context of this specification, a narrow particle size distribution shall be understood to be one where the ratio of weight-average particle diameter $D_w50$ determined by the analytical ultracentrifuge method and number-average particle diameter $D_N50$ [$D_w50/D_N50$] is not more than 2.0, preferably not more than 1.5 and especially preferably not more than 1.2 or not more than 1.1.

The production of a seed latex is common knowledge to the person skilled in the art and is generally effective in the presence of a large amount of emulsifier, which results in small particle sizes and a narrow particle size distribution. A general observation is that polymerizations that are conducted in the presence of such an exogenous seed latex—by contrast with an in situ seed latex—feature uniform particle growth. The seed latex, as already suggested by its name, is typically used in the form of an aqueous dispersion.

The seed latex is preferably a styrene polymer and/or methyl methacrylate polymer having a glass transition temperature ≥50° C., ≥60° C., ≥70° C., ≥80° C. or ≥90° C., measured to DIN EN ISO 11357-2 (2013-09).

Preferably 0.01 to 2 parts by weight and in particular 0.02 to 1 part by weight of seed latex is used (calculated as solids), based on total monomers.

The polymerization is preferably initiated in an initial charge containing up to 2 parts by weight of aqueous dispersion of a polystyrene seed latex based on 100 parts by weight of total monomers, and then monomers and emulsifier are metered in constantly.

In order to modify the properties of the polymers, it is optionally possible to conduct the emulsion polymerization in the presence of at least one chain transfer agent. These are typically used to reduce or to control the molecular weight of the polymers obtainable by a free-radical aqueous emulsion polymerization.

The weight-average molecular weights of the polymers formed can be adjusted using free-radical chain-transferring compounds (chain transfer agents). The compounds used here are essentially aliphatic and/or araliphatic halogen compounds, for example n-butyl chloride, n-butyl bromide, n-butyl iodide, methylene chloride, ethylene dichloride, chloroform, bromoform, bromotrichloromethane, dibromodichloromethane, carbon tetrachloride, carbon tetrabromide, benzyl chloride, benzyl bromide, organic thio compounds such as primary, secondary or tertiary aliphatic thiols, for example ethanethiol, n-propanethiol, 2-propanethiol, n-butanethiol, 2-butanethiol, 2-methyl-2-propanethiol, n-pentanethiol, 2-pentanethiol, 3-pentanethiol, 2-methyl-2-butanethiol, 3-methyl-2-butanethiol, n-hexanethiol, 2-hexanethiol, 3-hexanethiol, 2-methyl-2-pentanethiol, 3-methyl-2-pentanethiol, 4-methyl-2-pentanethiol, 2-methyl-3-pentanethiol, 3-methyl-3-pentanethiol, 2-ethylbutanethiol, 2-ethyl-2-butanethiol, n-heptanethiol and its isomeric compounds, n-octanethiol and its isomeric compounds, n-nonanethiol and its isomeric compounds, n-decanethiol and its isomeric compounds, n-undecanethiol and its isomeric compounds, n-dodecanethiol and its isomeric compounds, n-tridecanethiol and its isomeric compounds, substituted thiols, for example 2-hydroxyethanethiol, aromatic thiols, such as benzenethiol, ortho-, meta-, or para-methylbenzenethiol, mercaptoalkanoic acid and its derivatives, such as 6-methylheptyl 3-mercaptopropionate or 2-ethylhexyl 2-mercaptoethanoate, and all other sulfur compounds described in "Polymerhandbook" [Polymer Handbook], 3rd edition, 1989, J. Brandrup and E. H. Immergut, John Wiley & Sons, section II, pages 133-141, but also aliphatic and/or aromatic aldehydes, such as acetaldehyde, propionaldehyde, and/or benzaldehyde, unsaturated fatty acids, such as oleic acid, dienes having nonconjugated double bonds, such as divinylmethane, vinylcyclohexane or terpinolene, or hydrocarbons having readily abstractable hydrogen atoms, such as toluene. However, it is also possible to use mixtures of aforementioned chain transfer agent that do not interfere with one another.

If chain-transferring compounds are used in the polymerization, the respective amount used is for example 0.01 to 5 and preferably 0.1 to 3 parts by weight, based on 100 parts by weight of the monomers used during the polymerization.

According to the invention, the total amount of the chain transfer agent may be included in the initial charge in the aqueous reaction medium prior to initiation of the polymerization reaction. However, it is also possible to include only a portion of the chain transfer agent in the initial charge in the aqueous reaction medium prior to initiation of the polymerization reaction, and then, under polymerization conditions, to add the total amount or any remaining residual amount during the free-radically initiated emulsion polymerization as required in a continuous or discontinuous manner.

For completion of the polymerization reaction, it is sufficient in most cases to stir the reaction mixture after the monomer addition has ended, for example for another 0.5 to 3 hours at the polymerization temperature. A conversion of around 95% has then typically been achieved.

In order to increase the conversion still further and hence to lower the residual monomer content, it is possible for example to add further free-radical initiators from the group of the abovementioned initiators to the reaction mixture or to prolong the addition thereof and to conduct what is known as a "postpolymerization", i.e. a polymerization to achieve conversions of >95% up to 99%.

Such a postpolymerization can be conducted at the same, lower or else at higher temperature as/than the main polymerization. For example, 0.1 to 1.5 parts by weight, based on 100 parts by weight of the monomers used in the polymerization, of inorganic peroxide, preferably sodium peroxodisulfate, are metered in in this phase as initiator and the polymerization temperature is set to a temperature in the range from 80 to 120° C.

The pH can be for example 1 to 5 during the polymerization. After the end of the polymerization at a conversion of >95%, the pH is for example adjusted to a value between 6 and 7.

Chemical deodorization can in addition also be performed. If traces of residual monomers are still to be removed, this can also be done chemically by the action of abovementioned redox initiator systems, and systems as specified in DE-A 44 35 423, DE-A 44 19 518 and in DE-A 44 35 422.

The treatment with the redox initiator system is conducted in a temperature range from 60 to 115° C., preferably at 80 to 100° C. The redox partners can each independently be added to the dispersion in their entirety, in portions or constantly over a period of 10 minutes to 4 hours. To improve the postpolymerization action of the redox initiator systems, soluble salts of metals of varying valency, such as iron, copper or vanadium salts, may be added to the dispersion. Complexing agents which keep the metal salts in solution under the reaction conditions are also frequently added.

Following the polymerization reaction (main polymerization+postpolymerization) and optional chemical deodorization, it may be necessary to render the aqueous polymer dispersions largely free from odor carriers such as residual monomers and other volatile organic constituents, which is also referred to as physical deodorization. This can be achieved in a manner known per se by physical means by distillative removal (in particular via steam distillation) or by stripping with an inert gas.

The present invention also relates to the dispersions obtainable by the process of the invention that have a solids content of ≥58% by weight and a Brookfield viscosity of <1000 mPas measured at 100 rpm with spindle 3 at 23° C.

These are notable in that they are virtually coagulate-free aqueous dispersions. The amount of coagulate is in the ppm range and is preferably less than 2000 ppm, in particular less than 1000 ppm.

In addition, the polymer dispersions of the invention preferably have a solids content of ≥59% by weight, more preferably 60% by weight, preferably in the range from 59% to 65% by weight, based on the weight of the aqueous polymer dispersion.

The polymer dispersions obtained in accordance with the invention have a multimodal particle size distribution measured by AUC. The term "multimodal" is known to the person skilled in the art and refers to a particle size distribution of a dispersion having two or more maxima over the entire particle size curve (% by weight or intensity=y axis; particle size=x axis). However, for some embodiments of the dispersions, it is observed that the particle size distributions overlap so as to result in a very broad particle size distribution curve without recognizable maxima (broad Gaussian distribution curve), and so these can likewise be regarded as a multimodal polymer dispersion.

The aqueous polymer dispersions of the invention are used as a binder, adhesive, sizing agent for fibers, for the production of coatings or for the production of paper coating slips. The aqueous polymer dispersions of invention are suitable both for the sizing of textile fibers and for the sizing of mineral fibers, especially glass fibers. Because of their good adhesive strength, in particular when using comonomers which lead to a low glass transition temperature of the copolymer (e.g. less than 20° C.), they can also be used as an adhesive for example for the production of laminates and for the production of coatings such as for example barrier coatings. The aqueous polymer dispersions of the invention are preferably used as binders in paper coating slips.

The invention accordingly also provides a paper coating slip, comprising (i) inorganic pigment and (ii) an above-described aqueous polymer dispersion obtainable by the process of the invention (iii) and optionally further auxiliaries.

As well as water, paper coating slips generally comprise pigments, binders and auxiliaries for establishing the required rheological properties, for example thickeners. The pigments are typically dispersed in water. The paper coating slip comprises pigments in an amount of preferably at least 80% by weight, for example 80% to 95% by weight or 80% to 90% by weight, based on the total solids content.

White pigments are especially suitable. Examples of suitable pigments are metal salt pigments such as for example calcium sulfate, calcium aluminate sulfate, barium sulfate, magnesium carbonate and calcium carbonate, among which carbonate pigments and especially calcium carbonate are preferred. The calcium carbonate can be ground calcium carbonate (GCC, natural ground calcium carbonate), precipitated calcium carbonate (PCC), lime or chalk. Suitable calcium carbonate pigments are available for example as Covercarb® 60, Hydrocarb® 60 or Hydrocarb® 90 ME. Further suitable pigments are for example silicas, aluminum oxides, aluminum hydroxide, silicates, titanium dioxide, zinc oxide, kaolin, alumina, talc or silicon dioxide. Suitable further pigments are available for example as Capim® MP 50 (clay), Hydragloss® 90 (Clay) or Talcum C10.

The paper coating slip comprises the polymer dispersion produced in accordance with the invention as the sole binder or in combination with further binder. The most important functions of binders in paper coating slips are to bind the pigments to the paper and the pigments to each other and to some extent to fill cavities between pigment particles.

For example, 1 to 50 parts by weight, preferably 1 to 25 parts by weight or 5 to 20 parts by weight of the polymer of the invention per 100 parts by weight of pigments are used (in terms of solids, i.e. without water or other solvents which are liquid at 21° C. and 1 bar).

Preference is given to a paper coating slip comprising the polymers of the aqueous polymer dispersion in an amount of 1 to 50 parts by weight based on the total amount of pigments, and pigments in an amount of 80 to 95 parts by weight based on the total solids content, and an auxiliary, wherein the pigment is selected from the group consisting of calcium sulfate, calcium aluminate sulfate, barium sulfate, magnesium carbonate, calcium carbonate, silicas, aluminum oxides, aluminum hydroxide, silicates, titanium dioxide, zinc oxide, kaolin, alumina, talc and silicon dioxide, and wherein the auxiliary is selected from the group consisting of thickeners, further polymeric binders, co-binders, optical brighteners, fillers, leveling agents, dispersants, surfactants, lubricants, neutralizing agents, defoamers, deaerators, preservatives and dyes.

The further synthetic binders which differ from the polymers produced in accordance with the invention are common knowledge and are described for example in D. Urban and K. Takamura, Polymer Dispersions and Their Industrial Applications, 2002, Wiley-VCH Verlag GmbH, Weinheim, chapter 4.4.4, page 90 ff., the disclosure of which is expressly incorporated by reference.

Useful further binders include binders with a natural basis, in particular starch-based binders, and synthetic binders other than the polymers produced in accordance with the invention, especially emulsion polymers which can be produced by emulsion polymerization. In this context, "starch-based binders" is to be understood as meaning any native, modified or degraded starch. Native starches can consist of amylose, amylopectin or mixtures thereof. Modified starches can be oxidized starches, starch esters or starch ethers. The molar mass of the starch can be reduced by hydrolysis (degraded starch). Oligosaccharides or dextrins are possible degradation products. Preferred starches are cereal, corn and potato starches. Particular preference is given to cereal starch and corn starch, very particular preference is given to corn starch.

Paper coating slips of the invention may additionally comprise further auxiliaries, for example fillers, co-binders and thickeners for further optimizing viscosity and water retention, optical brighteners, dispersants, surfactants, lubricants (e.g. calcium stearate and waxes), neutralizing agents (e.g. NaOH or ammonium hydroxide) for adjusting pH, defoamers, deaerators, preservatives (e.g. biocides), leveling agents, dyes (in particular soluble dyes) etc. Useful thickeners include not only synthetic polymers (e.g. crosslinked polyacrylate) but also in particular celluloses, preferably carboxymethyl cellulose. Optical brighteners are for example fluorescent or phosphorescent dyes, in particular stilbenes.

The paper coating slip is preferably an aqueous paper coating slip; this comprises water in particular directly via the formulation form of the constituents (aqueous polymer dispersions, aqueous pigment slurries); the desired viscosity can be set via addition of further water. Customary solids contents of the paper coating slips are in the range from 30% to 80% by weight. The pH of the paper coating slip is preferably set to values of 6 to 11, in particular 7 to 10.

The invention also provides paper or board coated with a paper coating slip of the invention and a process for coating paper or board, wherein

- an aqueous polymer dispersion is produced in accordance with the invention; and
- a paper coating slip is produced using this polymer dispersion, at least one pigment and optional further auxiliaries; and the paper coating slip is applied to at least one surface of paper or board.

The paper coating slip is preferably applied to uncoated base papers or uncoated board. The amount is generally 1 to 50 g, preferably 5 to 30 g (in terms of solids, i.e. without water or other solvents which are liquid at 21° C., 1 bar) per square meter. Coating can be effected by means of customary application processes, for example by means of a size press, film press, blade coater, air brush, knife coater, curtain coating method or spray coater. Depending on the pigment system, the aqueous dispersions of the water-soluble copolymers can be used in paper coating slips for the base coat and/or for the topcoat.

The paper coating slips of the invention have good performance properties. They have good running characteristics in paper coating processes and have a high level of binding power. The coated papers and boards have good surface strength, especially a very high wet and dry pick resistance. They are readily printable in the customary printing processes, such as relief printing, intaglio printing, offset printing, digital printing, inkjet printing, flexographic printing, newsprint printing, letterpress printing, sublimation printing, laser printing, electrophotographic printing or a combination of these printing processes.

EXAMPLES

Unless the context indicates otherwise, percentages always signify percent by weight. Contents reported relate to the content in an aqueous solution or dispersion. Where water was used in the context of the examples, demineralized water was used.

Measurement Methods

Particle Size:

The particle size of the particles of the polymer dispersion and the particle size distribution were determined by analytical ultracentrifuge (AUC) with turbidity optics and Mie correction for transmitted intensities per unit size. Turbidity detection is used to measure all components of diameter 30 nm to 5 μm.

The method uses homogeneous starting sedimentation. The method was conducted according to the ISO 13318-1 guidelines, with description of the specific setup in W. Mächtle, L. Börger, "Analytical Ultracentrifugation of Polymers and Nanoparticles" chapter 3, Springer Science and Business Media, Berlin 2006, chapter 3. The evaluation proceeds from a spherical, solid particle form of the skeletal density given by the comonomer composition. The results are reported in volume metrics in sphere-equivalent diameters.

For the measurement, the dispersions are diluted to a concentration of 4 g (solids)/liter with a 0.05% by weight aqueous surfactant solution and analyzed under the same conditions.

The proportion by weight of a particle population is directly apparent from the integral from the measurement.

Determination of the Viscosity of the Dispersion:

The viscosity of the dispersion was determined to ASTM D2196 with a Brookfield viscometer with RV spindle 3 at 100 rpm and a temperature of 23° C.

Solids Content:

Solids contents of the polymer dispersions were determined by distributing 0.5 to 1.5 g of the polymer dispersion in a sheet metal lid of diameter 4 cm and then drying in an air circulation drying cabinet at 140° C. for 30 minutes. The ratio of the mass of the sample after drying under the above conditions to the mass of the sample taken gives the solids content of the polymer dispersion.

The following feedstocks were used in the examples:

- Emulsifier A: sodium lauryl sulfate in the form of a 15% by weight solution (Disponil® SDS from BASF)
- Emulsifier B: ethoxylated sodium lauryl ether sulfate in the form of a 28% by weight solution (Texapon® NSO P from BASF)
- Complexing agent: EDTA in the form of a 2% by weight solution (Trilon® BX from BASF)
- Seed latex: Polystyrene seed in the form of a 29.7% by weight dispersion with a particle size of approx. 30 nm (determined by means of analytical ultracentrifugation)
- Initiator A: 7% by weight solution of sodium peroxodisulfate (NaPS)
- Initiator B: 10% by weight solution of tert-butyl hydroperoxide
- Reducing agent: 13% by weight solution of acetone bisulfite In all examples, the feeds were metered in at a uniform mass flow rate, unless stated otherwise.

Production of the Emulsion Polymers

The following quantities in pphm (parts per hundred monomer) are based on 100 parts by weight of total monomer.

Example 1: Emulsion Polymerization of Styrene/Butadiene/Acrylic Acid/Acrylamide (57.7/38.4/3.11/0.75)—Inventive Initial Charge:

| | |
|---|---|
| 289.00 g | of water |
| 3.64 g | of a 29.7% by weight dispersion of a polystyrene latex (0.05 pphm) |
| 2.64 g | of acrylic acid (0.11 pphm) |
| 36.00 g | of a 2% by weight solution of EDTA (complexing agent) (0.03 pphm) |
| 2.40 g | of a 50% by weight solution of acrylamide (0.05 pphm) |
| 6.40 g | of a 15% by weight solution of sodium lauryl sulfate (emulsifier A) (0.04 pphm) |
| 48.00 g | of styrene (2.0 pphm) |
| 24.00 g | of butadiene (1.0 pphm) |

Addition 1:

| | |
|---|---|
| 51.43 g | of a 7% by weight solution of sodium peroxodisulfate (initiator A) (0.15 pphm) |

Feed 1:

| | |
|---|---|
| 33.60 g | of a 50% by weight solution of acrylamide (0.7 pphm) |
| 60.86 g | of a 28% by weight solution of ethoxylated sodium lauryl ether sulfate (emulsifier B) (0.71 pphm) |
| 54.72 g | of a 15% by weight solution of sodium lauryl sulfate (0.34 pphm) |
| 16.00 g | of 15% by weight sodium hydroxide solution (0.10 pphm) |
| 193.56 ml | of water |

Feed 2:

| | |
|---|---|
| 72.00 g | of acrylic acid (3.0 pphm) |
| 1337.76 g | of styrene (55.74 pphm) |
| 24.00 g | of tert-dodecyl mercaptan (1.00 pphm) |

Feed 3:

| | |
|---|---|
| 897.60 g | of butadiene (37.40 pphm) |

Feed 4:

| | |
|---|---|
| 480.00 g | of a 7% by weight solution of sodium peroxodisulfate (initiator A) (1.40 pphm) |

Feed 5 (Emulsifier Shot—Over 12 Min):

| | |
|---|---|
| 108.96 g | of a 15% by weight solution of sodium lauryl sulfate (0.68 pphm) |

Feed 6 (Emulsifier Shot—Over 1 Min):

| | |
|---|---|
| 80.00 g | of a 15% by weight solution of sodium lauryl sulfate (0.5 pphm) |

Feed 7:

| | |
|---|---|
| 40.80 g | of a 10% by weight solution of tert-butyl hydroperoxide (initiator B) (0.17 pphm) |

Feed 8:

| | |
|---|---|
| 45.96 g | of a 13.1% by weight solution of acetone bisulfite (0.27 pphm) |

Feed 9:

| | |
|---|---|
| 16.00 g | of 15% by weight sodium hydroxide solution (0.10 pphm) |

The components of the initial charge were placed in a 6 l pressure reactor and mixed. The initial charge was heated to 95° C. On attainment of 86° C., initiator A (addition 1) was added within 5 min, and the polymerization was commenced and the polymerization mixture was stirred for a further 3 minutes.

Immediately thereafter, feeds 1, 2, 3 and 4 were commenced (time: 0 minutes) and the temperature was increased continuously to 105° C. over a period of 30 minutes. Feeds 1, 2, 3 and 4 were effected over a period of 4 hours. Feed 5 was commenced after 2 hours and 9 minutes after the start of feeds 1, 2, 3 and 4 (time: 2 hours and 9 minutes) and was effected over the course of 12 minutes. Feed 6 was commenced after 3 hours and 20 minutes after the start of feeds 1, 2, 3 and 4 (time: 3 hours and 20 minutes) and was effected over the course of 1 minute.

After the metered addition of feeds 1, 2, 3 and 4 had ended, the polymerization mixture was stirred for a further 30 minutes. Subsequently, the polymerization mixture was cooled to a temperature of 95° C. and then 285.5 ml of water (11.89 pphm) was added and the mixture was neutralized to pH=5.5 with a 15% by weight sodium hydroxide solution. Subsequently, feeds 7, 8 and 9 were commenced simultaneously. Feeds 7 and 8 were effected over the course of a further 90 minutes. Feed 9 was effected over the course of 15 minutes. After the end of feeds 7 and 8, the polymerization mixture was cooled to room temperature.

The emulsion polymerization with the two "emulsifier shots" led to a low-viscosity dispersion with a high solids content. The solids content of the dispersion was 60% by weight. The dispersion at a pH of 5.5 had a viscosity of 590 mPas (spindle 3, 100 rpm).

The polymer dispersion was analyzed by analytical ultracentrifuge and showed a bimodal particle size distribution.

The particle population of the "small" particles had its peak maximum at 155 nm. The proportion of the overall polymer was 57% by weight.

The particle population of the "large" particles had its peak maximum at 187 nm. The proportion of the total polymer was 43% by weight.

Example 2 Emulsion Polymerization of Styrene/Butadiene/Acrylic Acid/Acrylamide (63.74/32.40/3.11/0.75)—Inventive Initial Charge:

| | |
|---|---|
| 289.00 g | of water |
| 3.64 g | of a 29.7% by weight dispersion of a polystyrene latex (0.05 pphm) |
| 2.64 g | of acrylic acid (0.11 pphm) |
| 36.00 g | of a 2% by weight solution of EDTA (complexing agent) (0.03 pphm) |
| 2.40 g | of a 50% by weight solution of acrylamide (0.05 pphm) |
| 6.40 g | of a 15% by weight solution of sodium lauryl sulfate (emulsifier A) (0.04 pphm) |
| 48.00 g | of styrene (2.0 pphm) |
| 24.00 g | of butadiene (1.0 pphm) |

Addition 1:

| | |
|---|---|
| 51.43 g | of a 7% by weight solution of sodium peroxodisulfate (initiator A) (0.15 pphm) |

Feed 1:

| | |
|---|---|
| 33.60 g | of a 50% by weight solution of acrylamide (0.7 pphm) |
| 60.86 g | of a 28% by weight solution of ethoxylated sodium lauryl ether sulfate (emulsifier B) (0.71 pphm) |
| 54.72 g | of a 15% by weight solution of sodium lauryl sulfate (0.34 pphm) |
| 16.00 g | of 15% by weight sodium hydroxide solution (0.10 pphm) |
| 193.56 ml | of water |

Feed 2:

| | |
|---|---|
| 72.00 g | of acrylic acid (3.0 pphm) |
| 1481.76 g | of styrene (61.74 pphm) |
| 24.00 g | of tert-dodecyl mercaptan (1.00 pphm) |

Feed 3:

| | |
|---|---|
| 753.60 g | of butadiene (31.40 pphm) |

Feed 4:

| | |
|---|---|
| 480.00 g | of a 7% by weight solution of sodium peroxodisulfate (initiator A) (1.40 pphm) |

Feed 5 (Emulsifier Shot—Over 12 Min):

| | |
|---|---|
| 108.96 g | of a 15% by weight solution of sodium lauryl sulfate (0.68 pphm) |

Feed 6 (Emulsifier Shot—Over 6 Min):

| | |
|---|---|
| 80.00 g | of a 15% by weight solution of sodium lauryl sulfate (0.5 pphm) |

Feed 7:

| | |
|---|---|
| 40.80 g | of a 10% by weight solution of tert-butyl hydroperoxide (initiator B) (0.17 pphm) |

Feed 8:

| | |
|---|---|
| 45.96 g | of a 13.1% by weight solution of acetone bisulfite (0.27 pphm) |

Feed 9:

| | |
|---|---|
| 16.00 g | of 15% by weight sodium hydroxide solution (0.10 pphm) |

The components of the initial charge were placed in a 6 l pressure reactor and mixed. The initial charge was heated to 95° C. On attainment of 86° C., initiator A (addition 1) was added within 5 min, and the polymerization was commenced and the polymerization mixture was stirred for a further 3 minutes.

Immediately thereafter, feeds 1, 2, 3 and 4 were commenced (time: 0 minutes) and the temperature was increased continuously to 105° C. over the course of 30 minutes. Feeds 1, 2, 3 and 4 were effected over a period of 4 hours. Feed 5 was commenced after 1 hour and 49 minutes after the start of feeds 1, 2, 3 and 4 (time: 1 hour and 49 minutes) and was effected over the course of 12 minutes. Feed 6 was commenced after 2 hours and 25 minutes after the start of feeds 1, 2, 3 and 4 (time: 2 hours and 25 minutes) and was effected over the course of 6 minutes.

Feeds 2, 3 and 4 were Each Metered in as Follows:

Over the first 20 minutes, a total of 7% of the monomers to be metered in was metered in, with the metering rate rising in a linear manner. Over the next 80 minutes, a total of 42.7% of the monomers to be metered in was metered in at a constant metering rate. Over the next 140 minutes, a total of 50.3% of the monomers to be metered in was metered in, with the metering rate dropping in a linear manner. The ratios of the monomers to one another remained unchanged.

After the metered addition of feeds 1, 2, 3 and 4 had ended, the polymerization mixture was stirred for a further 30 minutes. Subsequently, the polymerization mixture was cooled to a temperature of 100° C. and then 285.5 ml of water (11.89 pphm) was added and the mixture was neutralized to pH=5.5 with a 15% by weight sodium hydroxide solution. Feeds 7, 8 and 9 were commenced thereafter. Feeds 7 and 8 were effected over the course of a further 90 minutes. Feed 9 was effected over the course of 15 minutes. After the end of feeds 7 and 8, the polymerization mixture was cooled to room temperature.

The emulsion polymerization with the two "emulsifier shots" led to a low-viscosity dispersion with a high solids content. The solids content of the dispersion was 60% by weight. The dispersion at a pH of 5.5 had a viscosity of 677 mPas (spindle 3, 100 rpm).

The polymer dispersion was analyzed by analytical ultracentrifuge and showed a multimodal particle size distribution.

The particle population of the "small" particles had its peak maximum at 30 nm. The proportion of the overall polymer was 17% by weight.

The particle population of the "medium-sized" particles had its peak maximum at 135 nm. The proportion of the total polymer was 33% by weight.

The particle population of the "large" particles had its peak maximum at 170 nm. The proportion of the total polymer was 50% by weight.

Example 3 Emulsion Polymerization of Styrene/Butadiene/Acrylic Acid/Acrylamide (57.74/38.4/3.11/0.75)—Inventive Initial Charge:

| | |
|---|---|
| 289.00 g | of water |
| 3.64 g | of a 29.7% by weight dispersion of a polystyrene latex (0.05 pphm) |
| 2.64 g | of acrylic acid (0.11 pphm) |
| 36.00 g | of a 2% by weight solution of EDTA (complexing agent) (0.03 pphm) |
| 2.40 g | of a 50% by weight solution of acrylamide (0.05 pphm) |
| 6.40 g | of a 15% by weight solution of sodium lauryl sulfate (emulsifier A) (0.04 pphm) |
| 48.00 g | of styrene (2.0 pphm) |
| 24.00 g | of butadiene (1.0 pphm) |

Addition 1:

| | |
|---|---|
| 51.43 g | of a 7% by weight solution of sodium peroxodisulfate (initiator A) (0.15 pphm) |

Feed 1:

| | |
|---|---|
| 33.60 g | of a 50% by weight solution of acrylamide (0.7 pphm) |
| 60.86 g | of a 28% by weight solution of ethoxylated sodium lauryl ether sulfate (emulsifier B) (0.71 pphm) |
| 54.72 g | of a 15% by weight solution of sodium lauryl sulfate (0.34 pphm) |

-continued

| | |
|---|---|
| 16.00 g | of 15% by weight sodium hydroxide solution (0.10 pphm) |
| 193.56 ml | of water |

Feed 2:

| | |
|---|---|
| 72.00 g | of acrylic acid (3.0 pphm) |
| 1337.76 g | of styrene (55.74 pphm) |
| 24.00 g | of tert-dodecyl mercaptan (1.00 pphm) |

Feed 3:

| | |
|---|---|
| 897.60 g | of butadiene (37.40 pphm) |

Feed 4:

| | |
|---|---|
| 480.00 g | of a 7% by weight solution of sodium peroxodisulfate (initiator A) (1.40 pphm) |

Feed 5 (Emulsifier Shot—Over 12 Min):

| | |
|---|---|
| 108.96 g | of a 15% by weight solution of sodium lauryl sulfate (0.68 pphm) |

Feed 6 (Emulsifier Shot—Over 6 Min):

| | |
|---|---|
| 80.00 g | of a 15% by weight solution of sodium lauryl sulfate (0.5 pphm) |

Feed 7:

| | |
|---|---|
| 40.80 g | of a 10% by weight solution of tert-butyl hydroperoxide (initiator B) (0.17 pphm) |

Feed 8:

| | |
|---|---|
| 45.96 g | of a 13.1% by weight solution of acetone bisulfite (0.27 pphm) |

Feed 9:

| | |
|---|---|
| 16.00 g | of 15% by weight sodium hydroxide solution (0.10 pphm) |

The components of the initial charge were placed in a 6 l pressure reactor and mixed. The initial charge was heated to 95° C. On attainment of 86° C., initiator A (addition 1) was added within 5 min, and the polymerization was commenced and the polymerization mixture was stirred for a further 3 minutes.

Immediately thereafter, feeds 1, 2, 3 and 4 were commenced (time: 0 minutes) and the temperature was increased continuously to 105° C. over a period of 30 minutes. Feeds 1, 2, 3 and 4 were effected over a period of 4 hours. Feed 5 was commenced after 1 hour and 49 minutes after the start of feeds 1, 2, 3 and 4 (time: 1 hour and 49 minutes) and was effected over the course of 12 minutes. Feed 6 was commenced after 3 hours and 20 minutes after the start of feeds 1, 2, 3 and 4 (time: 3 hours and 20 minutes) and was effected over the course of 6 minutes.

Feeds 2, 3 and 4 were Metered in as Follows:

Over the first 20 minutes, a total of 7% of the monomers to be metered in was metered in, with the metering rate rising in a linear manner. Over the subsequent 80 minutes, a total of 42.7% of the monomers to be metered in was metered in at a constant metering rate. Over the subsequent 140 minutes, a total of 50.3% of the monomers to be metered in was metered in, with the metering rate dropping in a linear manner. The ratios of the monomers to one another remained unchanged.

After the metered addition of feeds 1, 2, 3 and 4 had ended, the polymerization mixture was stirred for a further 30 minutes. Subsequently, the polymerization mixture was cooled to a temperature of 100° C. and then 285.5 ml of water (11.89 pphm) was metered in and the mixture was neutralized to pH=5.5 with a 15% by weight sodium hydroxide solution. Feeds 7, 8 and 9 were commenced thereafter. Feeds 7 and 8 were effected over the course of a further 90 minutes. Feed 9 was effected over the course of 15 minutes. After the end of feeds 7 and 8, the polymerization mixture was cooled to room temperature.

The emulsion polymerization with the two "emulsifier shots" led to a low-viscosity dispersion with a high solids content. The solids content of the dispersion was 60% by weight. The dispersion at a pH of 5.5 had a viscosity of 412 mPas (spindle 3, 100 rpm).

The polymer dispersion was analyzed by analytical ultracentrifuge and showed a multimodal particle size distribution.

The particle population of the "small" particles had its peak maximum at 30 nm. The proportion of the overall polymer was 20% by weight.

The particle population of the "medium-sized" particles had its peak maximum at 140 nm. The proportion of the total polymer was 43% by weight.

The particle population of the "large" particles had its peak maximum at 165 nm. The proportion of the total polymer was 37% by weight.

Example 4: Emulsion Polymerization of Styrene/Butadiene/Methacrylic Acid/Acrylamide (57.74/38.4/3.11/0.75)—Inventive The polymerization was conducted as described in example 3, except that the acrylic acid was replaced in each case by methacrylic acid. The emulsion polymerization with the two "emulsifier shots" led to a low-viscosity dispersion with a high solids content.

The solids content of the dispersion was 60% by weight.

The dispersion at pH 5.5 had a viscosity of 360 mPas.

The polymer dispersion was analyzed by analytical ultracentrifuge and showed a multimodal particle size distribution.

The particle population of the "small" particles had its peak maximum at 40 nm. The proportion of the overall polymer was 23% by weight.

The particle population of the "medium-sized" particles had its peak maximum at 162 nm. The proportion of the total polymer was 40% by weight.

The particle population of the "large" particles had its peak maximum at 188 nm. The proportion of the total polymer was 37% by weight.

Example 5: Emulsion Polymerization of Styrene/Butadiene/Acrylic Acid (57.6/38.4/4)—Noninventive Initial Charge:

| | |
|---|---|
| 372.00 g | of water |
| 21.2 g | of a 29.7% by weight dispersion of a polystyrene latex (0.3 pphm) |
| 12.00 g | of a 2% by weight solution of EDTA (complexing agent) (0.01 pphm) |
| 19.20 g | of a 15% by weight solution of sodium lauryl sulfate (emulsifier A) (0.12 pphm) |
| 48.00 g | of styrene (2.0 pphm) |
| 24.00 g | of butadiene (1.0 pphm) |

Addition 1:

| | |
|---|---|
| 51.43 g | of a 7% by weight solution of sodium peroxodisulfate (initiator A) (0.15 pphm) |

Feed 1:

| | |
|---|---|
| 42.86 g | of a 28% by weight solution of ethoxylated sodium lauryl ether sulfate (emulsifier B) (0.5 pphm) |
| 38.40 g | of a 15% by weight solution of sodium lauryl sulfate (0.24 pphm) |
| 16.00 g | of 15% by weight sodium hydroxide solution (0.10 pphm) |
| 266.64 ml | of water |

Feed 2:

| | |
|---|---|
| 96.00 g | of acrylic acid (4.0 pphm) |
| 1334.40 g | of styrene (55.74 pphm) |
| 24.00 g | of tert-dodecyl mercaptan (1.00 pphm) |

Feed 3:

| | |
|---|---|
| 897.60 g | of butadiene (37.40 pphm) |

Feed 4:

| | |
|---|---|
| 291.43 g | of a 7% by weight solution of sodium peroxodisulfate (initiator A) (0.85 pphm) |

Feed 5 (Emulsifier Shot—Over 12 Min):

| | |
|---|---|
| 160.00 g | of a 15% by weight solution of sodium lauryl sulfate (1.0 pphm) |

Feed 6:

| | |
|---|---|
| 40.80 g | of a 10% by weight solution of tert-butyl hydroperoxide (initiator B) (0.17 pphm) |

Feed 7:

| | |
|---|---|
| 45.96 g | of a 13.1% by weight solution of acetone bisulfite (0.27 pphm) |

Feed 8:

| | |
|---|---|
| 72.00 g | of 25% by weight sodium hydroxide solution (0.10 pphm) |

The components of the initial charge were placed in a 6 l pressure reactor and mixed. The initial charge was heated to 95° C. On attainment of 86° C., initiator A (addition 1) was added within 5 min, and the polymerization was commenced and the polymerization mixture was stirred for a further 3 minutes.

Immediately thereafter, feeds 1, 2, 3 and 4 were commenced (time: 0 minutes) and the temperature was increased continuously to 105° C. over a period of 30 minutes. Feeds 1, 2, 3 and 4 were effected over a period of 4 hours. Feed 5 was commenced after 2 hours and 36 minutes after the start of feeds 1, 2, 3 and 4 (time: 2 hours and 36 minutes) and was effected over the course of 12 minutes. After the metered addition of feeds 1, 2, 3 and 4 had ended, the polymerization mixture was stirred for a further 30 minutes. Subsequently, the polymerization mixture was cooled to a temperature of 95° C. and then 343.92 ml of water (14.33 pphm) was metered in and the mixture was neutralized up to pH=5.5 with a 15% by weight sodium hydroxide solution.

Feeds 7, 8 and 9 were commenced thereafter. Feeds 7 and 8 were effected over the course of a further 90 minutes. Feed 9 was effected over the course of 15 minutes. After the end of feeds 7 and 8, the polymerization mixture was cooled to room temperature.

The polymerization with just one "emulsifier shot" with a water content intended to lead to a solids content of 60% by weight led to coagulate.

The invention claimed is:

1. A process for producing an aqueous polymer dispersion by free-radically initiated aqueous emulsion polymerization, characterized in that, in an aqueous medium, (a) 40 to 75 parts by weight of styrene, (b) 24.9 to 59.9 parts by weight of butadiene, (c) 0.1 to 10 parts by weight of at least one ethylenically unsaturated carboxylic acid and (d) 0 to 15 parts by weight of one or more other monomers, where the parts by weight of monomers (a) to (d) add up to 100 parts by weight, are polymerized by a monomer feed process comprising the following steps:

a) initially charging a seed latex and 1 to 10 parts by weight of monomers based on the total amount of monomers, b) initiating the polymerization at a temperature ≥80° C. in this initial charge, c) and then constantly metering monomers and emulsifier into this reaction mixture, c1) characterized in that, at a time when 40% to 55% of the total monomer metering time has elapsed and 40 to 55 parts by weight of the amount of monomers to be metered in have been metered in, the metering rate of the emulsifier is increased for a period P2 of not longer than 30 minutes to 10 to 150 times the average metering rate of the emulsifier during the period P1, where the period P1 is the preceding period of time commencing with the start of emulsifier metering, c2) and, at a time when 60% to 85% of the total monomer metering time has elapsed and 60 to 85 parts by weight of the amount of monomers to be metered in have been metered in, the metering rate of the emulsifier is increased for a period P4 of not longer than 30 minutes to 10 to 150 times the average metering rate of the emulsifier in period P1, with the proviso that the aqueous polymer dispersion has a solids content of ≥58% by weight.

2. The process as claimed in claim 1, characterized in that the ethylenically unsaturated carboxylic acid is selected from acrylic acid, methacrylic acid and itaconic acid.

3. The process as claimed in claim 1, characterized in that 0.1 to 15 parts by weight of other monomer (d) are polymerized.

4. The process as claimed in claim 1, characterized in that the other monomer (d) is selected from acrylamide, methacrylamide, acrylonitrile, methacrylonitrile, N-methylolacrylamide, N-methyl (meth)acrylamide, vinyl esters of saturated C to C18 carboxylic acids, esters of acrylic acid and of methacrylic acid with monohydric C to C18 alcohols, allyl esters of saturated carboxylic acids, vinyl ethers, vinyl ketones, dialkyl esters of ethylenically unsaturated carboxylic acids, N-vinylpyrrolidone, N-vinylpyrrolidine, N-vinylformamide, N,N-dialkylaminoalkylacrylamides, N,N-dialkylaminoalkylmethacrylamides, N,N-dialkylaminoalkyl acrylates, N,N-dialkylaminoalkyl methacrylates, vinyl chloride and vinylidene chloride, and mixtures thereof.

5. The process as claimed in claim 1, characterized in that the following are polymerized in the aqueous medium:

(a) 40 to 75 parts by weight of styrene, (b) 24.8 to 59.8 parts by weight of butadiene, (c) 0.1 to 10 parts by weight of at least one ethylenically unsaturated carboxylic acid and d1) 0.1 to 5 parts by weight of acrylamide and/or methacrylamide, d2) 0 to 10 parts by weight of one or more other monoethylenically unsaturated monomers, where the parts by weight of monomers (a) to (d) add up to 100 parts by weight.

6. The process as claimed in claim 1, characterized in that the aqueous polymer dispersion has a solids content of ≥59% by weight.

7. The process as claimed in claim 1, characterized in that the monomers are metered in at a constant mass flow rate over a period of at least 100 minutes.

8. The process as claimed in claim 1, characterized in that the emulsifier is selected from alkali metal and ammonium salts of $C_8$-$C_{22}$-alkyl sulfates, sulfuric monoesters of ethoxylated alkanols, sulfuric monoesters of ethoxylated alkylphenols, and bis(phenylsulfonic acid) ethers or the alkali metal or ammonium salts thereof that bear a C4-C24-alkyl group on one or both aromatic rings.

9. The process as claimed in claim 1, characterized in that 0.1 to 5 parts by weight of emulsifier based on 100 parts by weight of monomers are metered in constantly in a mixture with at least one monomer.

10. The process as claimed in claim 1, characterized in that polymerization is effected at a temperature in the range from ≥80° C. to ≤115° C.

11. The process as claimed in claim 1, characterized in that the seed latex used is a styrene polymer and/or methyl methacrylate polymer having a glass transition temperature ≥50° C. as claimed in DIN EN ISO 11357-2 (2013-09).

12. An aqueous polymer dispersion obtainable by the process as claimed in claim 1 that has a solids content of ≥58% by weight and a Brookfield viscosity of <1000 mPa·s measured at 100 rpm with spindle 3 at 23° C.

13. A paper coating slip comprising (i) inorganic pigments and (ii) an aqueous polymer dispersion as claimed in claim 12 and optionally further auxiliaries.

* * * * *